US005243319A

United States Patent [19]

Brokaw

[11] Patent Number: 5,243,319

[45] Date of Patent: Sep. 7, 1993

[54] TRIMMABLE RESISTOR NETWORK PROVIDING WIDE-RANGE TRIMS

[75] Inventor: Adrian P. Brokaw, Burlington, Mass.

[73] Assignee: Analog Devices, Inc., Norwood, Mass.

[21] Appl. No.: 784,965

[22] Filed: Oct. 30, 1991

[51] Int. Cl.[5] ..... H01C 10/10

[52] U.S. Cl. ..... 338/195; 338/260; 338/299; 338/319

[58] Field of Search ..... 338/195, 260, 295, 319, 338/320, 4; 333/130; 219/121.68

[56] References Cited

U.S. PATENT DOCUMENTS 4,016,483 4/1977 Rudin ..... 338/92 X
4,191,938 3/1980 Gow, 3rd et al. ..... 338/195
4,777,826 10/1988 Rud, Jr. et al. ..... 338/4 X

*Primary Examiner*—Marvin M. Lateef
*Attorney, Agent, or Firm*—Parmelee, Bollinger & Bramblett

[57] ABSTRACT

A trimmable resistor network including a plurality of series-connected sections each including a plurality of paralleled link resistors each capable of being cut so as to be eliminated from the network, the paralleled resistors in each section having resistance values such that the section resistance changes by at least approximately integral multiples of a fixed amount when the resistors are cut.

15 Claims, 3 Drawing Sheets

TRIMMABLE RESISTOR NETWORK PROVIDING WIDE-RANGE TRIMS

BACKGROUND OF THE INVENTION

1. Field of the Invention

This invention relates to trimmable resistor networks especially for use as a part of an integrated circuit (IC). More particularly, this invention relates to such networks of the type comprising a number of individual links which can be selectively cut to change the resistance presented by the network.

2. Description of the Prior Art

Integrated circuits often require resistors the resistance values of which can be trimmed over a wide range. For example, such resistors may be needed to adjust the net resistance of a circuit resistor having an initial tolerance of ±20%, to an absolute tolerance less than a fraction of a percent. Even wider trim range is necessary to ratio-match resistors having different compositions and tolerances as great as ±30%. In ratio matching, the trim range must accommodate the sum of both sets of tolerances. Other cases arise in practice which also require substantial trim range.

A large trim range can be provided by an individual resistor which is controllably cut through a major portion of its area. Such a technique is however unsatisfactory in many respects. Large trim range resistors are often very large in area, and require long and time consuming trims which makes the parts (ICs) expensive to manufacture. These long trims produce a large "wound" and surrounding the completely trimmed kerf is a partially trimmed transition region which is less stable than the untrimmed portion of the resistor. The wounded area typically exhibits a slightly different temperature coefficient than the untrimmed portion of the resistor. If a resistor is trimmed over a long portion of its length, the relatively larger wound may seriously affect stability and temperature tracking.

Some of these problems can be overcome by use of link trimming. In this approach, a resistor is constructed so that it has a number of alternative conduction paths through links which may be selectively cut. Generally, when one of these links is cut, the path is opened and no current flows in the cut region. This makes the trimmed resistor essentially free of the stability and TC effects produced by wounds in a large-area trim resistor.

One type of link network comprises a pair of parallel conductors having a series of link resistors connected between the conductors, somewhat like ties of a railroad track. By cutting many links, a large change in resistance can be obtained. One last link can be partially cut to make a fine adjustment in the resistor values. This one cut can have a small area so as to have only a minor effect on stability or TC.

This railroad track design has a number of limitations. Because all of the links are in parallel, a large width must be trimmed, requiring long trim times. Such a resistor network also is relatively large and inefficient in terms of trim linearity. The effect of cutting an individual link depends upon the number of links already cut. If all links are of equal width, the first few links cut have a much smaller effect on overall resistance than the effect of the last few after many have been cut. This is opposite to what is desired, i.e., a large coarse trim followed by finer high-resolution trimming.

To overcome these deficiencies, modifications have been proposed to the railroad track design, such as using links of different sizes which are selectively cut to achieve predetermined changes in resistance. Many of these modification schemes suffer from the weakness that although a large number of resistance values can be obtained, many of these values are redundant, or may not be useful because they are so far away from other values that there is no practical way to interpolate between them. Thus, the actual useful range and resolution of such a design is much less than the range of possible resistance values or the resolution of the smallest change.

SUMMARY OF THE INVENTION

In one preferred embodiment of the invention to be described in detail hereinbelow, a resistor network is provided comprising a number of series-connected sections (three in one example) each consisting of two parallel-connected link resistors. Either of the two resistors in each section can be selectively cut thereby providing three possible resistance values for each section. The values of the links are selected so that the resistance of a given section can be trimmed, by cutting through links, to values which divide the trim range of the section into equal sub-ranges.

The trim range of a first section is made less than the total network trim range by the amount of one of the section sub-ranges. For example, a given two-resistor section can be made to have values R, $R+\Delta R_1$, and $R+2\Delta R_1$. If the total trim range intended for this section and all others of less range is $R_T$, then the link resistors are sized to provide that $3\Delta R_1=R_T$. The given section can be trimmed by 0, $\Delta R_1$, or $2\Delta R_1$, so that the resistance of the section can be brought to within $\Delta R_1$ of the maximum desired value. Then, $\Delta R_1$ is chosen as the full trim range of the remaining sections.

For example, the next series-connected section of lesser range is arranged to trim by amounts 0, $\Delta R_2$, $2\Delta R_2$ where $3\Delta R_2=\Delta R_1 (=R_T/3)$. In this way, the first section trimmed can reduce the difference between the actual and desired value to less than a predetermined fraction of the total trim range allowed for. The next section can reduce this predetermined fraction of the trim range to an even smaller range, by the same method, and so further reduce the difference between the actual and desired value. Proceeding in this way, sections can be added to reduce the actual to desired difference by any specified amount. Finally, any residual difference can be reduced by a small continuous trim of a series-connected one-resistor section. Since the continuous trim range required of this one resistor can be made arbitrarily small, by the addition of multi-resistor sections, the adverse effects of a continuous trim can be reduced to any desired degree.

DETAILED DESCRIPTION OF PREFERRED EMBODIMENTS

Figure 1:
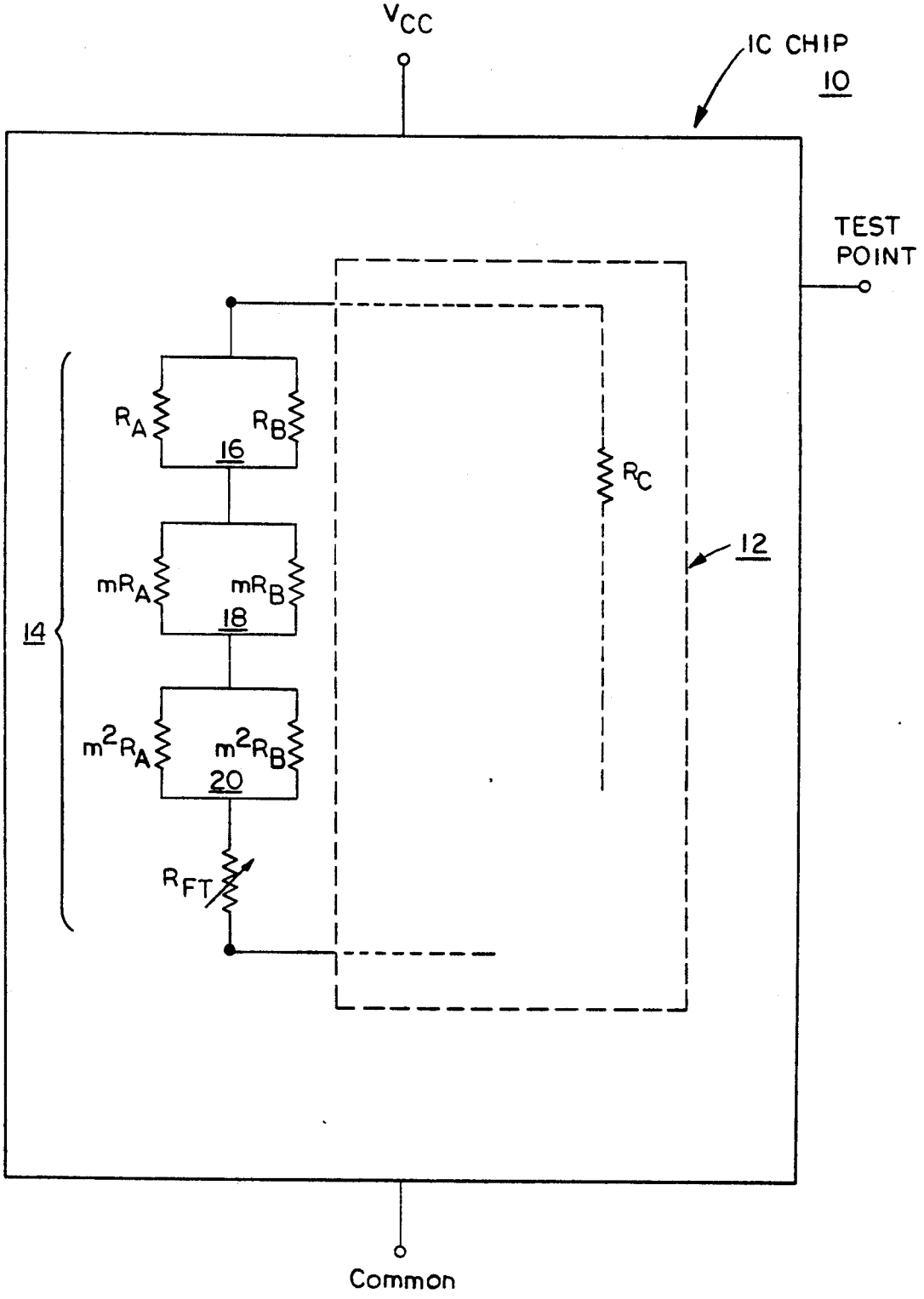
FIG. 1 is a circuit diagram together with pictorial elements to illustrate one embodiment of the invention.

Referring now to FIG. 1, there is shown pictorially an IC chip 10 having an internal circuit 12 of any kind requiring a trimmable resistor to establish precise operating conditions, for example, to be combined with a circuit resistor $R_C$ having a resistance with a large variability. A network for trimming the resistance in accordance with this invention is generally indicated at 14. The trimming operation is carried out by making electrical measurements at a test point which is connected internally to a preselected node (not shown) in the circuit 12, and selectively cutting resistors of the network 14 in accordance with the observed measurement values at that test point.

Figure 2:
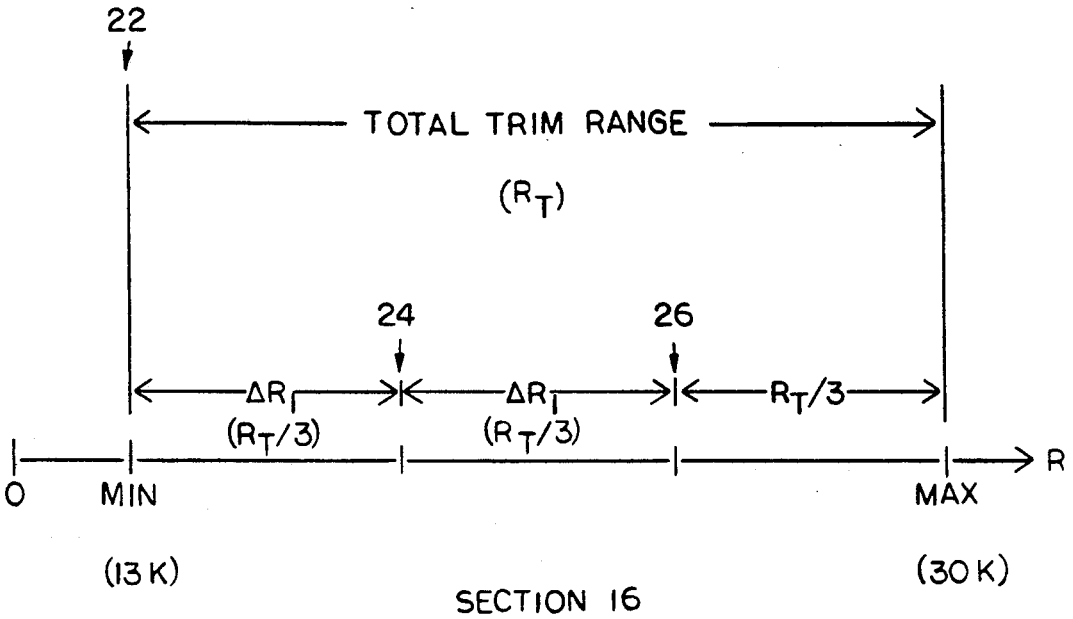
FIG. 2 is a line graph presenting the total trim range for the embodiment of FIG. 1, and showing how that trim range is divided into equal-sized sub-ranges of a first section of the network.
Figure 3:
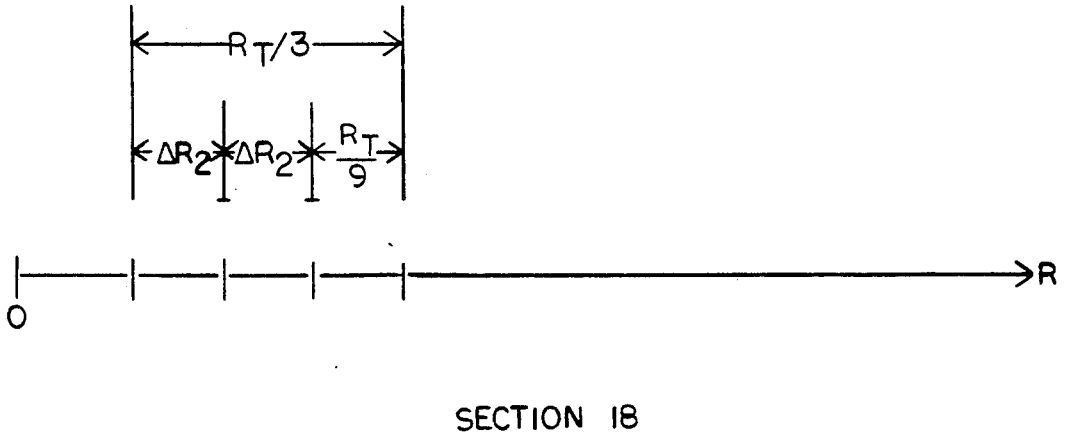
FIG. 3 is a line graph showing how a second section of the network further trims one sub-range of the first section.

The network 14 includes three series-connected sections 16, 18, 20 each consisting of two parallel-connected link resistors adapted to be cut through as part of the trimming operation. Any one of the sections can take on three useful values, one for both resistors uncut, and the other two which result from cutting one or the other link. Referring particularly to the first section 16, and referring also to FIG. 2, these three resistance values 22, 24, 26 are shown to differ by equal amounts designated $\Delta R_1$. The difference in resistance of the two links $R_A$ and $R_B$ must be $\Delta R_1$ in order that the two cases where one is cut will differ by $\Delta R_1$. The difference between the smaller of the two link resistors and their parallel combination must also be $\Delta R_1$.

Designating $R_A$ as the smaller of the two link resistors, it will be evident that:

$$R_A+\Delta R_1=R_B$$

and also that:

$$((R_AR_B)/(R_A+R_B))+\Delta R_1=R_A.$$

By substituting:

$$(R_A(R_A+\Delta R_1)/(R_A+R_A+R_1))+\Delta R_1=R_A$$

$$R_A^2 2+R_A\Delta R_1+2R_A\Delta R_1+\Delta R_1^2=2R_A^2+R_A\Delta R_1$$

$$\Delta R_1^2 2R_A\Delta R_1-R_A^2=0$$

$$\Delta R_1=\frac{-2R_A\pm\sqrt{4R_A^2+4R_A^2}}{2}$$

$$\Delta R_1=R_A(\sqrt{2}-1)$$

$$R_B=R_A+\Delta R_1=\sqrt{2}\,R_A$$

The parallel combination of $R_A$ and $R_B$ is given by:

$$R_A \| R_B=\frac{R_A^2\sqrt{2}}{R_A+\sqrt{2}\,R_A}=$$

$$\frac{R_A\sqrt{2}}{1+\sqrt{2}}\;\frac{1-\sqrt{2}}{1-\sqrt{2}}=R_A(2-\sqrt{2})$$

Therefore the three values $R_A(2-\sqrt{2})$, $R_A$, and $R_A\sqrt{2}$ differ in steps of $R_A(\sqrt{2}-1)$. Considering that a total trim range of RT must be provided for, and starting from the untrimmed value of the parallel sections, the resistance can be trimmed up at the first section by one times $(\sqrt{2}-1)R_A$ or two times $(\sqrt{2}-1)R_A$. A third such sub-range can be trimmed by other sections giving $$3(\sqrt{2}-1)R_A=R_T \quad \text{(the selected design value for total trim range)}$$

Solving this equation for $R_A$:

$$R_A=R_T/3(\sqrt{2}-1).$$

By cutting one, the other or neither of the two parallel resistors $R_A$ and $R_B$, the actual resistance of the first section 16 can be brought to within $\frac{1}{3}$ of the planned trim range $R_T$ from the desired value.

The remaining trim range, $R_T/3$, can then be chosen as the range for the remainder of the trimmable resistor. The next section can be designed to reduce any remaining difference to $\frac{1}{3}(R_T/3)$ or $R_T/3^2$. A third section can be used to reduce the difference to $R_T/3^3$. Additional sections can be employed to approximate the desired value as closely as desired. As a practical matter, once a large range has been substantially reduced by link trimming, a small continuously trimmed resistor $R_{FT}$ can be used as a fine trim, to give a final adjustment.

It will be seen that the values selected for the section resistors (e.g., $R_A$ and $R_B$) are in accordance with one aspect of the invention selected such that the resistance of the corresponding section changes by at least approximately integral multiples of a fixed amount when the resistors are cut. The fixed amount in this case is designated $\Delta R_1$. The resistor values also are selected to provide that the increment of change in the section resistance divides the trim range for the section by one more than the number of increments available. In the described example, the change in section resistance $\Delta R_1$ divides the trim range ($R_T$) for the section by three, which is one more than the number of increments available ($2\Delta R_1$). The resistance values for the lesser-range sections have the same ratios as those of the first section, and are scaled-down versions of the resistors of the immediately-preceding section. This scaling factor is designated "m" in FIG. 1.

Actual resistance values for a network 14 having a design trim range of 17K, with a minimum value of 13K and a maximum value of 30K, are (rounded off) as follows:

| | |
|---|---|
| $R_A$ = 13.68K | $R_B$ = 19.35K |
| $mR_A$ = 4.56K | $mR_B$ = 6.45K |
| $m^2R_A$ = 1.52K | $m^2R_B$ = 2.15K |

The continuously variable fine trim resistor $R_{FT}$ can for this network have a value which is variable between 1.426K and 2.485K.

A network in accordance with the invention can employ sections with more than two paralleled resistors. For example, network sections having three paralleled resistors may be advantageous for some applications. Considering such a three-resistor section, and normalizing it to a unit value for the "first" of three resistors, the three resistors will be: 1, 1+A and 1+2A, where A is a constant. Thus:

$$\frac{1}{\frac{1}{1+A}+\frac{1}{1+2A}}=1-A$$

$$\frac{(1+A)(1+2A)}{1+A+1+2A}+A-1=0$$

$$5A^2+2A-1=0$$

which has roots:

$$A=\frac{-1\pm\sqrt{6}}{5}$$

The positive root has a value about 0.29.

If the three resistors have values R, (1+0.29)R and (1+2×0.29)R, the parallel combinations will have four values which differ from one another by about 0.29R (as a sub-range of the section trim range). These four values are:

0.71R

1R 1.29R 1.58R (There are other possible values from the available parallel combinations, but these do not provide equal sub-ranges and are not further considered here.)

This three-resistor section could be one of three similar series-connected sections. If the parallel combination of 1, 1+A and 1+2A is defined as P, the lowest resistance multiplier the first section can have, the largest value the section can have is 2AR, or 1.58R (which would be $2\Delta R_1$ in the terminology used with FIG. 2). Adding in the range of the remainder must result in $R_T$, the desired total trim range:

$$((1+2A)+A-P)R=R_T$$

or $$R=R_T/(1+3A-P)$$

This will give the values for the resistors in the first section. The resistors in the second and third sections will be in the same ratios as the first, to give the desired increments, but scaled down to give the correct range for interpolating the preceding sections. The scale factor will be:

$$m=\frac{A}{1+3A-P}$$

Thus, the second section resistors are the same as in the first section except multiplied by "m". Similarly, the third section resistors should be the same as the first section except multiplied by "$m^2$". Calculating values for such a network having three-resistor sections:

$$P=0.45$$

$$m=0.199$$

$$R=\frac{17K}{1+3\times 0.29-.415}=11.685K \text{ ("first" resistor)}$$

The final set of resistor values are (rounded off):

| | | | |
|---|---|---|---|
| 1st Section: | 11.7K | 15K, | 18.4K |
| 2nd Section: | 2.3K | 3K, | 3.7K |
| 3rd Section: | 464 ohms | 599 ohms | 733 ohms |
| $R_{FT}$: | | 6.74K to 8K | |

Figure 4:
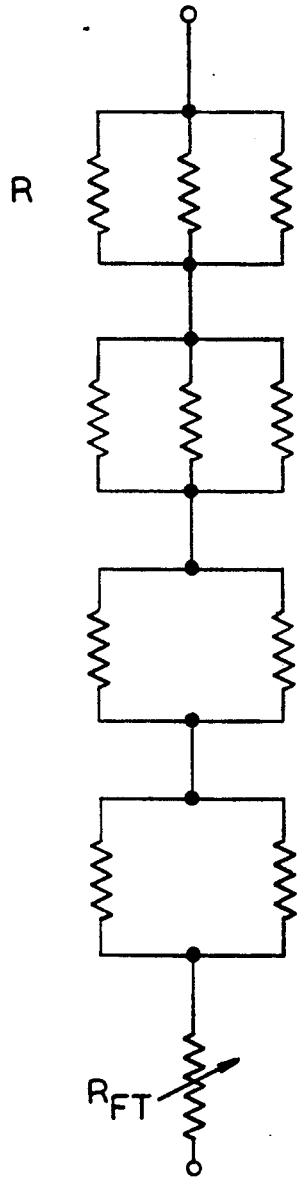
FIG 4 is a circuit diagram illustrating further embodiments of the invention.

For some applications, it may be desirable to use multiple sections which have different numbers of resistors, with each however providing equal sub-ranges as described. Such a network is shown in FIG. 4.

Although several preferred embodiments of the invention have been disclosed herein in detail, it is to be understood that this is for the purpose of illustrating the invention, and should not be construed as necessarily limiting the scope of the invention since it is apparent that many changes can be made by those skilled in the art while still practicing the invention claimed herein.

What is claimed is:

1. A trimmable multiple-link type resistor network wherein trimming is effected by selectively cutting link resistors of said network;

said network comprising:

a plurality of series-connected sections each including a plurality of paralleled link resistors each capable of being cut so as to be eliminated from the network;

the values of at least two of said paralleled resistors in each section being different from one another and selected such that the resistance of the section changes by increments which are at least approximately integral multiples of a fixed amount when either of the two resistors is cut.

2. A network as claimed in claim 1 wherein said resistor values also are selected such that the increment of change in the section resistance divides the trim range for the section by one more than the number of increments available.

3. A resistor network as claimed in claim 1, wherein each section consists of a pair of parallel-connected link resistors.

4. A resistor network as claimed in claim 3, wherein the values of said resistors in one section are in a ratio of $\sqrt{2}$.

5. A resistor network as claimed in claim 4, wherein the values of the resistors in each of the remaining sections are in a ratio of $\sqrt{2}$.

6. A resistor network as claimed in claim 1, wherein each section consists of three paralleled resistors.

7. A resistor network as claimed in claim 6, wherein the resistor values in at least one section are related by a factor of at least approximately 0.29.

8. A resistor network as claimed in claim 7, wherein the resistor values at least one further section also are related by a factor of 0.29.

9. A resistor network as claimed in claim 1, wherein one section consists of three paralleled resistors and another section consists of two paralleled resistors.

10. A trimmable resistor network to be connected at one point to a circuit resistor having a value which is not known but which is predictably within a predetermined range of values, and wherein the resistance of the network between said one point and another point together with the resistance of the circuit resistor is to product a specific composite resistance value achieved by trimming said resistor network by selectively cutting link resistors of said network in accordance with electrical measurements;

said network comprising:

a plurality of series-connected sections each including a plurality of link resistors each capable of being cut so as to be eliminated from the network;

the values of at least two of said network resistors being different from one another and set such that the incremental change in the total network resistance caused by cutting any one of said two resistors of one section will be at least approximately an integral multiple of a fixed value.

11. A resistor network as claimed in claim 10, wherein each of said link resistors in each section are parallel-connected.

12. A resistor network as claimed in claim 11, wherein at least one section consists of two paralleled link resistors.

13. A resistor network as claimed in claim 11, wherein there are three paralleled resistors having resistance values related by a factor of approximately 0.29.

14. A trimmable multiple-link type resistor network wherein trimming is effected by selectively cutting link resistors of said network;

said network comprising:

a plurality of series-connected sections each including a plurality of paralleled link resistors each capable of being cut so as to be eliminated from the network;

the values of at least two of said paralleled resistors in each section being selected such that the resistance of the section changes by at least approximately integral multiples of a fixed amount when the resistors are cut, said values further being selected such that the resistance of the section after the cutting of one of said two resistors will be different from the resistance which results when the other of said two resistors is cut.

15. A resistor network as claimed in claim 14, wherein each section consists of a pair of parallel-connected link resistors.

* * * * *